United States Patent [19]

Nicolai

[11] Patent Number: 5,076,130

[45] Date of Patent: Dec. 31, 1991

[54] FRENCH HORN

[76] Inventor: Van O. Nicolai, 206 Apple Blossom Ct., Vienna, Va. 22181

[21] Appl. No.: 478,217

[22] Filed: Feb. 9, 1990

[51] Int. Cl.[5] ..... G10D 9/04

[52] U.S. Cl. ..... 84/389

[58] Field of Search ..... 84/387 R, 387 A, 388, 84/389, 390–394, 395–401; D17/10, 11, 12, 13

[56] References Cited

U.S. PATENT DOCUMENTS 2,484,408 10/1949 Hubley ..... 84/390

3,686,995 8/1972 Marzan ..... 84/389

*Primary Examiner*—L. T. Hix

*Assistant Examiner*—Howard B. Blankenship

[57] ABSTRACT

French horns with four finger valves and one change horn valve, instead of the standard three finger valves and one change horn valve enable play in twelve keys, as well as twelve tones. Point and dimple connections between key levers and rotary valve string bars provide smooth translation of the string bars and smooth rotation of the rotary valve hubs. Screw-on mouthpieces and mouthpipes have smooth identical inner diameters to avoid the airstream disrupting steps of conventional push-in mouthpieces. Cork block mountings between the tubes, valves and slides instead of the standard soldered metal mountings avoid transmission of vibrations between the tubes. Hand straps steady the French horns instead of the usual finger hooks.

6 Claims, 6 Drawing Sheets

FRENCH HORN

BACKGROUND OF THE INVENTION

Historically, the French horn was a descendent of a hunting horn without valves but with the right hand placed in the bell to vary the pitch. When the orchestra changed key the hand horn was replaced by one of different length; twelve different horns were needed to play all twelve-keys.

The modern French horn is a compromise of two three-valve horns; the thumb valve changes the key from F to B flat. The result is a twelve-tone per octave instrument, but hand position and lip tension must be varied to obtain hand horn pitches in any key.

SUMMARY OF THE INVENTION

A French horn with four finger valves and one change horn valve, instead of the standard three finger valves and one change horn valve enables play in twelve-keys. Point and dimple connections between key levers and rotary valve string bars provides smooth translation of the string bars and smooth rotation of the rotary valve hubs. A screw-on mouthpiece and mouthpipe have smooth identical inner diameters to avoid the airstream disrupting step of conventional push-in mouthpieces. Cork block mountings between the tubes instead of the standard soldered metal mountings avoid transmission of vibration between the tubes. A hand strap steadies the French horn instead of the usual hook which is engaged by a little finger.

The present invention provides a double horn with four valves per horn. It can be used as a twelve-tone instrument but can also produce hand horn pitches for twelve-keys with much less hand and lip correction than with the standard horn. Orchestral playing is cleaner and easier.

A preferred B flat-E flat descant, twelve-key, twelve-tone French horn has a mouthpiece, a mouthpipe connected to a mouthpiece and tubing connected to the mouthpipe. Multiple tuning slides and bypass valves are connected to the tubing. A bell is connected to an end of the tubing remote from the mouthpipe. The valves include one change horn valve and four rotary bypass valves sequentially connected to the change horn valve and to each other with the tubing for selectively directing wind into first, second, third and fourth tuning slide tubes associated respectively with the first, second, third and fourth valves and to bypass the first, second, third and fourth tuning slide tubes according to positions of the valves for varying keys and tones.

The preferred French horn further has first, second, third and fourth finger key control levers rotationally mounted on the horn. First, second, third and fourth rotational hubs are mounted on the first, second, third and fourth valves. Strings are connected to the rotary hubs, and string bars are connected to the strings. Links are connected to the key levers, and point and dimple means respectively interconnect the string bars and links. Connective means connect ends of the string bars and links for permitting relative realignment between ends of the string bars and links as the finger key levers, links and string bars are moved to move the strings and to turn the hubs of the rotary valves.

In a preferred embodiment, a hand strap is connected to the tubing near the finger levers for surrounding a palm-knuckle portion of a hand.

In a preferred embodiment, the mouthpiece and mouthpipe have similar inner dimensions for forming a smooth inner transitional surface between the mouthpipe taper and mouthpiece taper. An external connection extends over abutting ends of the mouthpipe and mouthpiece and connects the mouthpipe and mouthpiece together.

These and other and further objects and features of the invention are described in the disclosure, which includes the above and ongoing written description including the claims and the drawings.

DETAILED DESCRIPTION OF THE DRAWINGS

Figure 1:
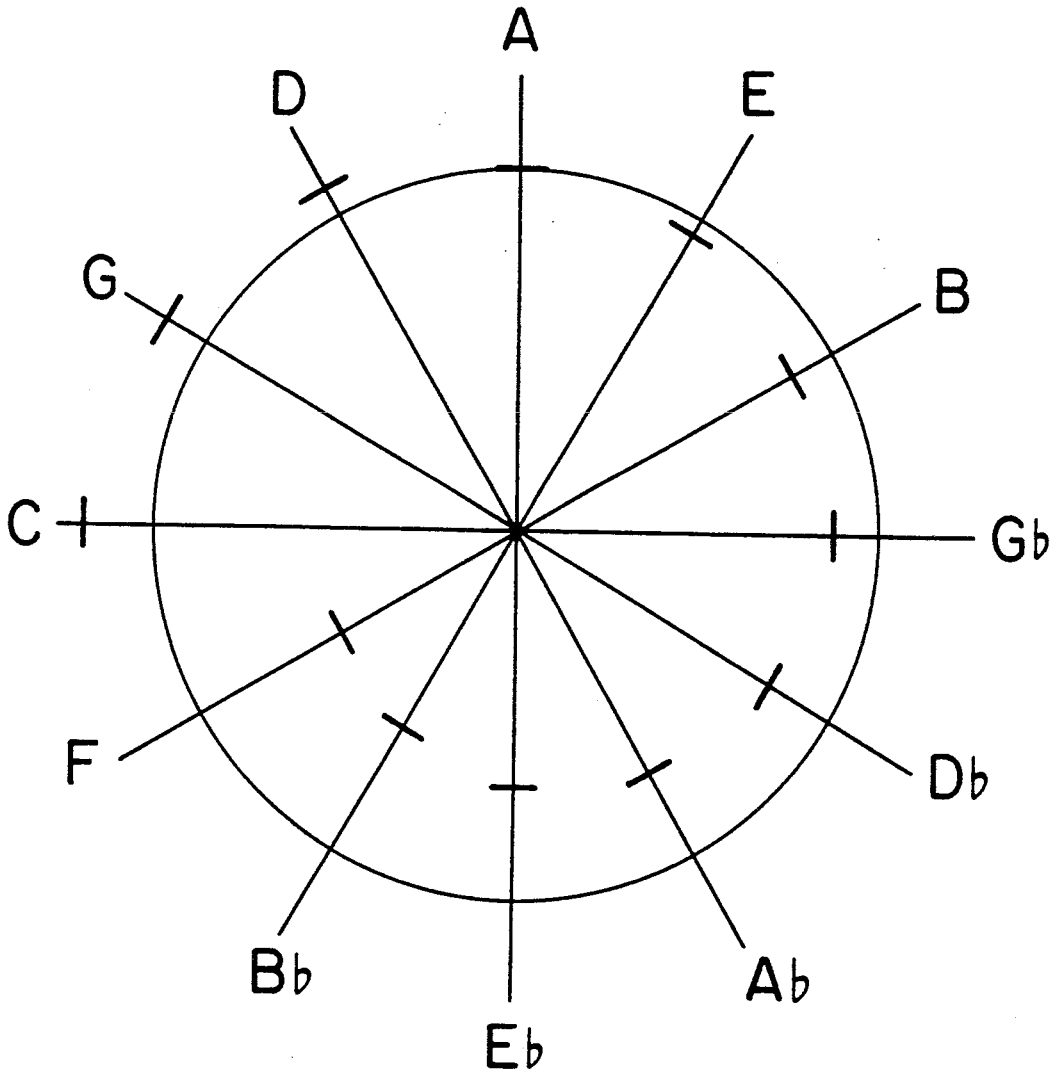
FIG. 1 is a circle of fifths showing string keynotes.

Referring to FIG. 1, the circle of fifths shows the twelve string keys in which the horn of the present invention is played.

Figure 2:
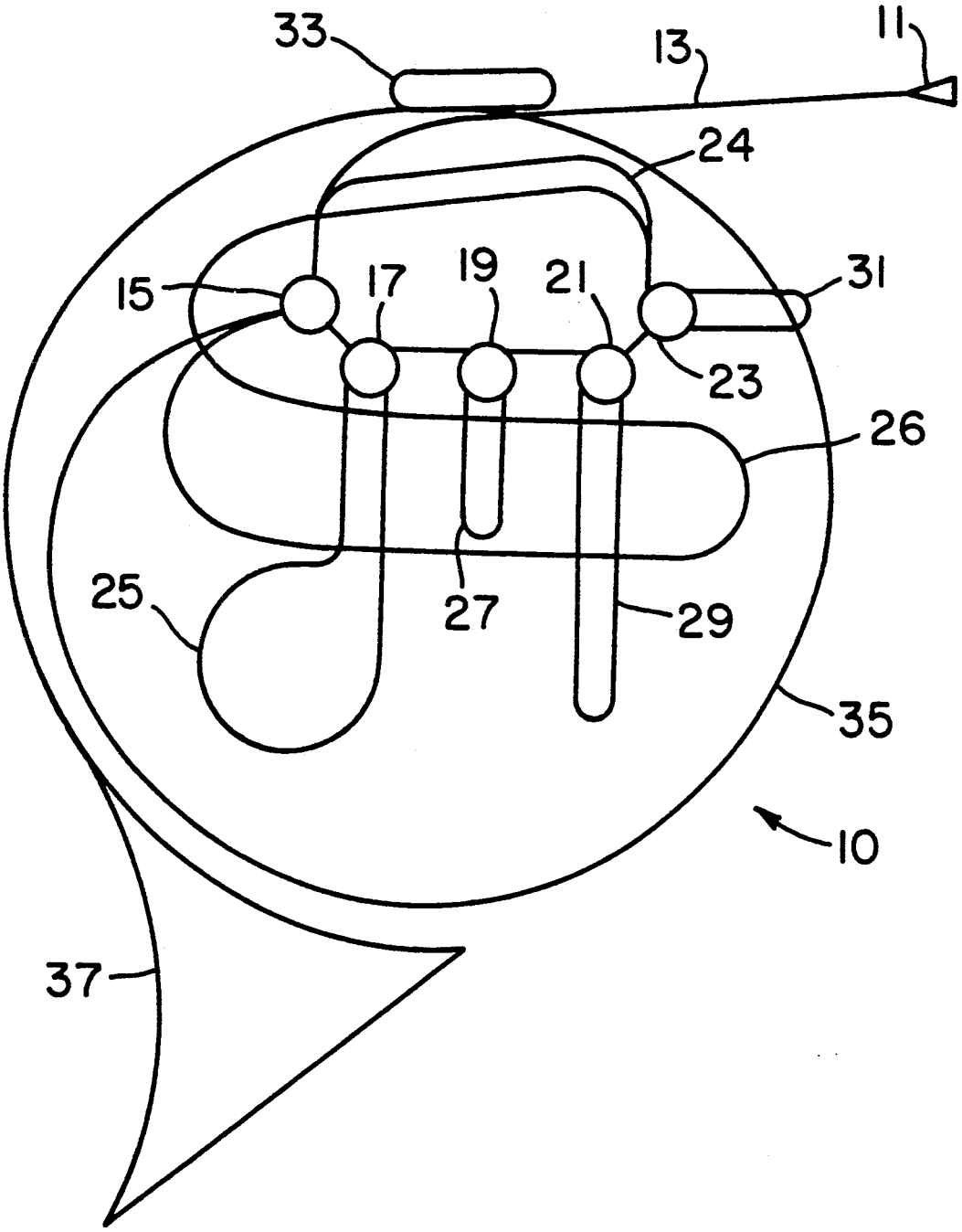
FIG. 2 is a schematic representation of a five valve B flat, E flat descant horn of the present invention.

FIG. 2 shows a horn 10 of the present invention having a mouthpiece 11 attached to a mouthpipe 13, the mouthpipe supplies sound waves to a change horn valve 15 which supplies the sound waves to four successive rotary bypass valves 17, 19, 21 and 23. 24 is E flat tuning slide. 26 is B flat tuning slide. Each bypass valve is connected to tubing lengths 25, 27, 29 and 31 which may be slid for precise adjustment. Each of the finger valves 17–23 is provided with a finger lever and string bar. The horn is provided with a palm-knuckle hand encircling loop 33 instead of the finger hook provided on conventional French horns. The hand encircling loop 33 allows each of the four fingers to operate the keys which control valves 17–23. Change horn valve 15 is operated by a thumb valve. Tubing 35 leads to bell 37. The horn is played in twelve-keys and twelve-tones as described in the specification and in the accompanying tables.

Figure 3:
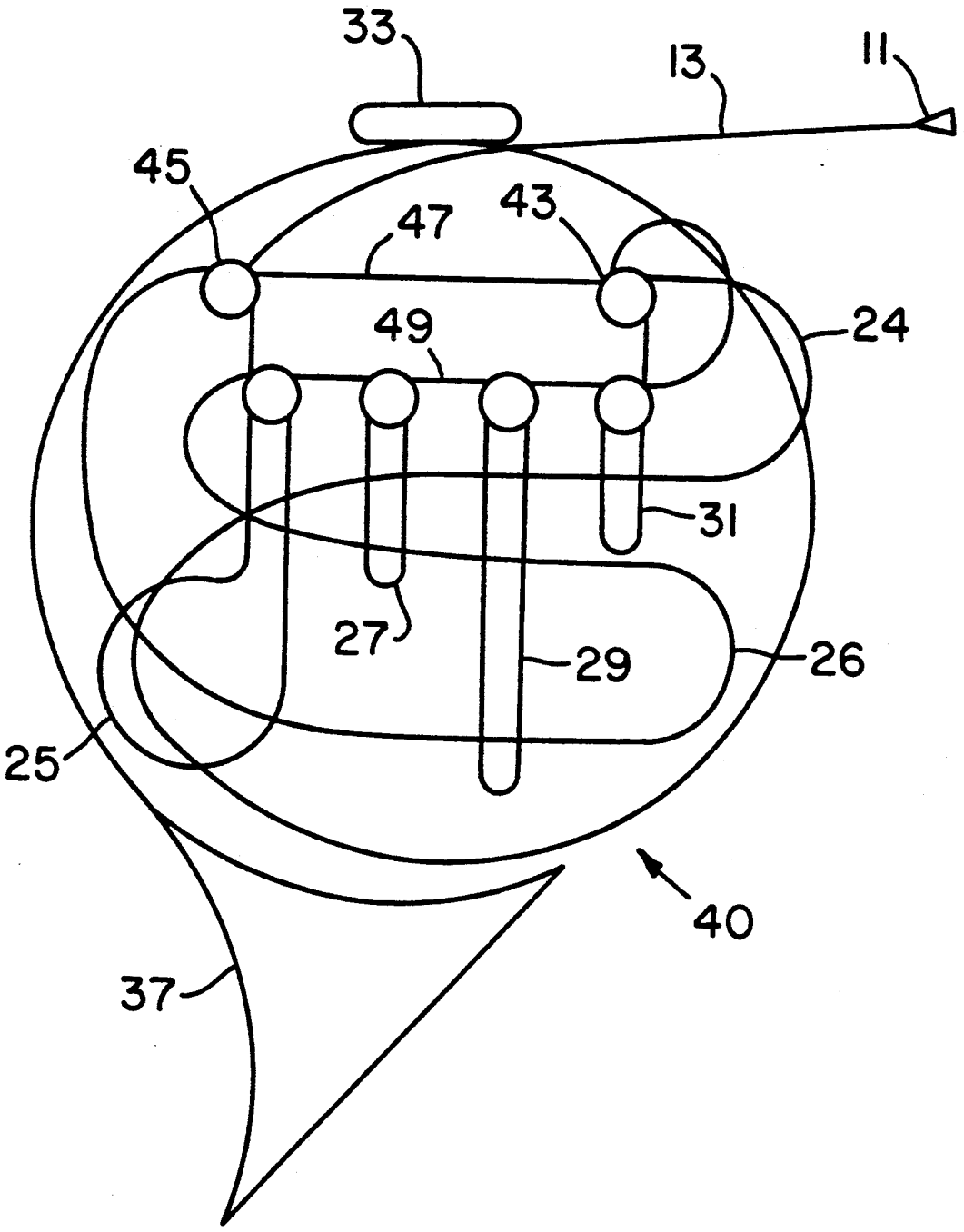
FIG. 3 is a schematic representation of two ganged single change valves with four finger valves in a horn of the present invention.

As shown in FIG. 3, horn 40 has several elements which are numbered similarly to like elements in FIG. 2. The change horn valve 15 in FIG. 1 is replaced with two single ganged change valves 43 and 45 which have a mechanical interconnection 47. Each of the valves 17–23 is made of two rotary bypass valves controlled with finger key lever movements to control the sound waves along tubing 49 to engage or bypass the tuning slide loops 25 through 31. 24 is common tuning slide. 26 is b flat tuning slide.

Similar, loops of different lengths are provided on the other ends of the valves.

Figure 4:
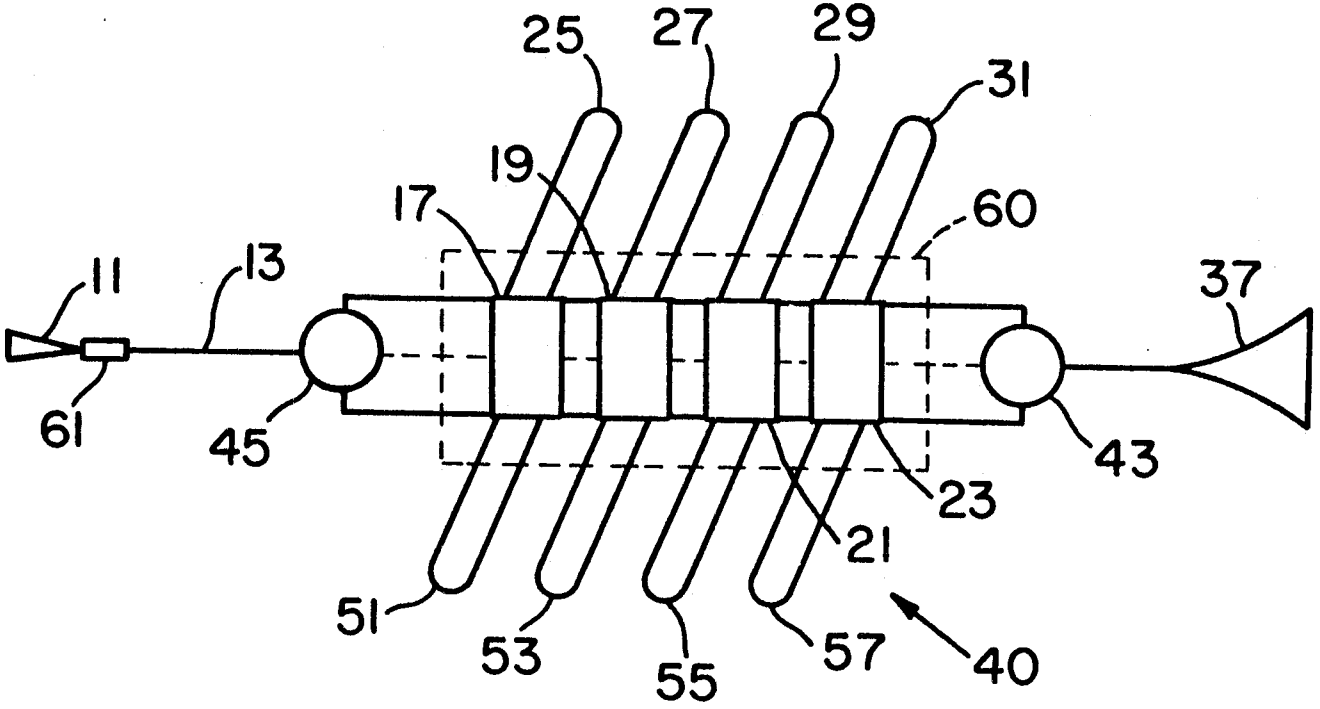
FIG. 4 is a schematic representation of a horn of the present invention.

The schematic representation of FIG. 4 shows the horn 40 of the present invention and the additional adjustable tubing loops 51, 53, 55 and 57 which are controlled for connecting or bypassing by the same rotary valves 17 through 23.

As shown schematically, each of the tubing elements is separated from adjacent elements by a cork block 60 which is hot glued to the tubing elements. Mouthpiece 11 is connected by a collar 61 to the mouthpipe 13. Details of the connections are shown in FIG. 5.

Figure 5:
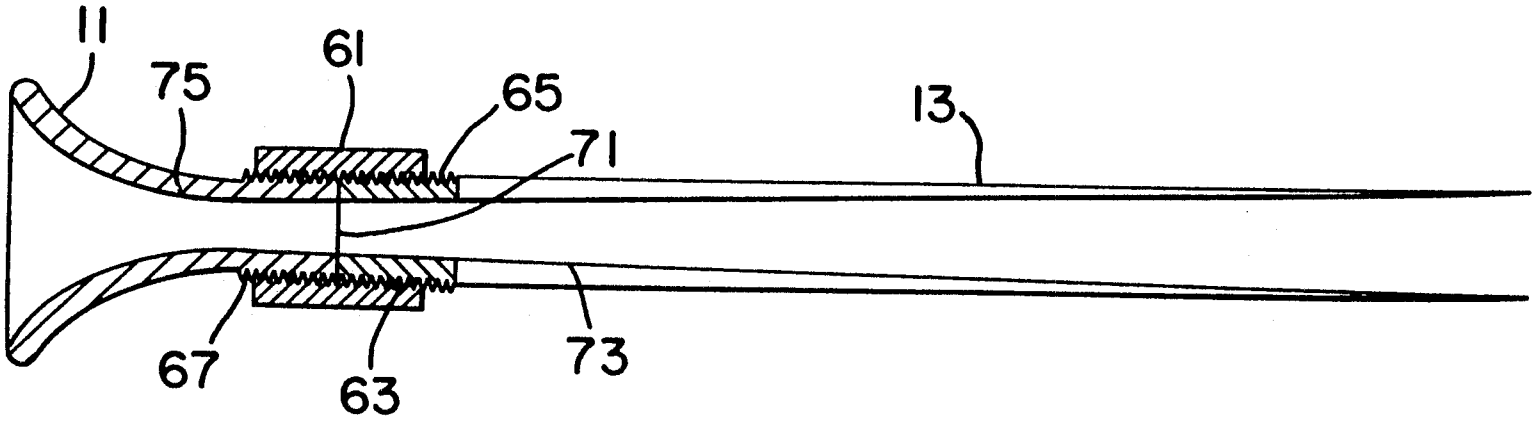
FIG. 5 is a detail of a screwed-on mouthpiece of the present invention.

In FIG. 5, mouthpiece 11 is connected to the mouthpipe 13 by a collar 61 which has internal threads 63 engaging external threads 65 on the mouthpipe and similar external threads 67 on the mouthpiece 11. The internal diameters of the mouthpiece 11 and mouthpipe 13 are identical at junction 71, forming a smooth taper 73 from the throat 75 to the change valve.

Figure 6:
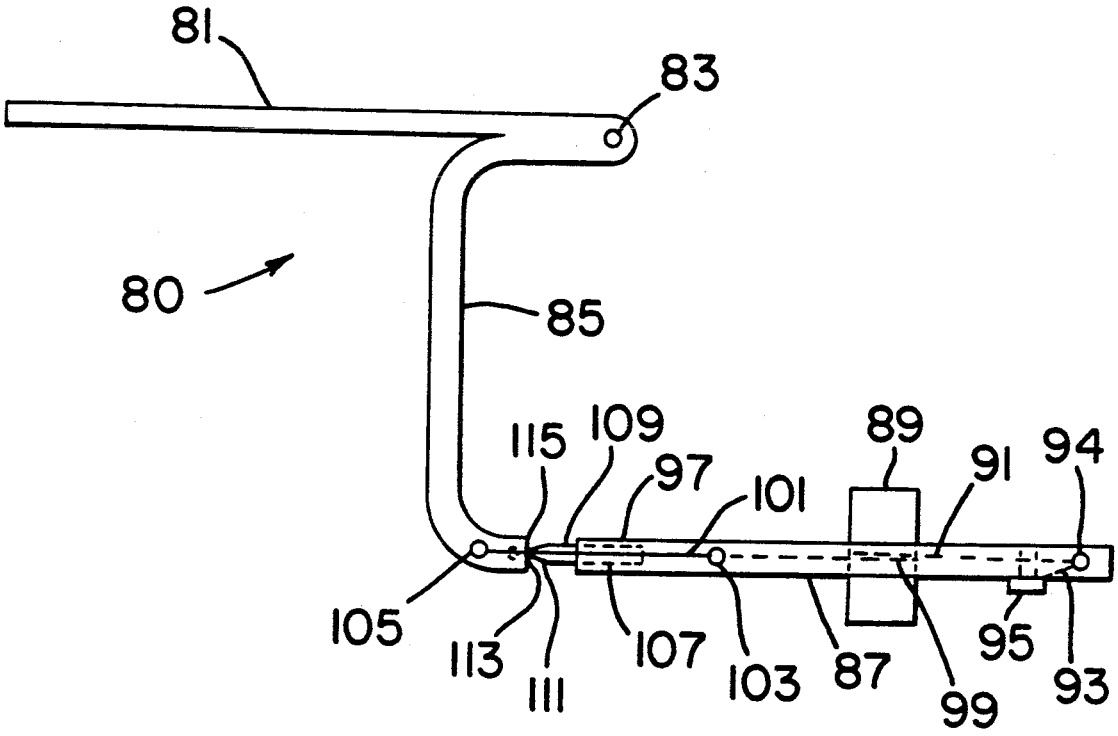
FIG. 6 is a detail of a preferred key, link and string bar connection of the present invention.

As shown in FIG. 6, each finger key is supplied with a finger key valve operator 80. Each operator 80 has a finger key lever 81 which pivots on an axle 83. Connected at right angles to the key lever 81 for pivoting on the same axle is a link 85. Each link 85 is connected to a string bar 87 which has a string wrapped around a hub 89 on one of the four rotary bypass valves 17 through 23.

A string 91 has a first end 93 passing through an opening 94 at a distal end of the string bar. The distal end of the string is attached to a tightening screw 95. The conventional string is attached near a proximal end 97 of the string bar 87, after wrapping the loop 99 around the hub 89 and securing the loop 99 to the hub so that translation of the string bar 87 turns the hub 89. In the present invention, the proximal portion 101 of the string is passed through a hole 103 in the string bar 87 and attaches to an opening or screw 105 in the link. The string bar 87 has a recess 107 in its proximal end 97, and the recess is fitted with a pointed rod 109. The point 111 on the rod fits within a recess 113 or dimple in the end 115 of the link 85. Tension of the string 91 holds the point 111 in the recess 113. Thus, alignment of the finger key lever 81 and the link 85 may be changed without changing the perpendicular relation of the string bar 87 and the hub 89. Uniquely, the same string is used to connect the link 85 and the string bar 87 as is used to connect the string bar 87 and the hub 89. The nylon or twisted linen string 91 is changed twice a year. A primary difference between the string of the present invention and the string of the prior art is that the nylon string is passed through opening 103 and anchored at point 105 in the link 85.

In an alternate form of the invention, separate nylon strings or other connectors such as tension springs or clips may be used.

In one prior art device finger lens 81, link 85, and string bar 87 are all one solid piece. Pressing the key moves the string bar at the hub 89 both to the right and up, resulting in a rough conversion of key motion into rotation of the hub 89.

In another prior art device, the finger lens 81 and link 85 are a single solid piece and an axle on the end of link 85 connects to a bearing on the end of string bar 87. This construction also results in a smooth conversion of key motion into rotation of the hub 89, but is more time consuming and costly than the point and dimple construction.

The piano has twelve-keys per octave. A piano tuner adjusts each string so that the pitch is the twelfth root of two times the lower adjacent string. This so-called tempered scale is represented on a circle-of-fifths diagram shown in FIG. 1 as the circle. On the diagram higher pitches are placed toward the center of the circle. Lower pitches are placed outside the circle.

Approximately half of an orchestra is made up of string players. String players do not use tempered scales. Their strings are tuned to perfect fifths; the pitch of one string is 1.5 times the pitch of the lower adjacent string. The 7th power of the twelfth root of 2 is 1.4983061. The difference between these two numbers divided by the average will be designated as ▮ ; the unit of pitch between two adjacent keys on the piano turns out to be 51 ▮ . Since both the piano and strings tune to a 440 A, the A string falls on the circle. For ▮ $=\frac{1}{8}''$, the C, G, D, and E fall as shown on the diagram. There is no B string; the B keynote is taken to be a perfect fifth above E.

String players find the keynotes for F, B flat, E flat and A flat by going down a major third from the open strings, A, D, G and C, respectively. A major third has a 1.25 frequency ratio and is 11 ▮ sharper than the value from the circle of perfect fifths. D flat and G flat are found by going down perfect fifths from A flat to complete the keynote diagram for strings as shown in FIG. 1.

The hand horn acts like a tube open at both ends. However, when the hand is forced into the bell, the bell is acoustically stopped or closed. Physical acoustics makes the tube resonate when the tube length is equal to an integer n of quarter wavelengths. When the bell end is open, n is an even integer. When the bell end is stopped, n is an odd integer. The wave equation gives the resonant frequency $f$ in terms of the velocity of sound in air c and the tube length L as $f=nc/4L$. Within one octave, all twelve notes played in a given tube have frequencies given by that relation, but with different values for n. The hand horn automatically produces those pitches. Good singers, good string players and good players of other orchestral instruments will produce these same hand horn pitches characteristic of that key. The present invention produces the same pitches for all twelve-keys on one instrument.

Phillip Farkas, *The Art of French Horn Playing*, Clayton F. Summy Co., Chicago, 1956, recommends tuning the French horn to the piano, but playing with strings is simplified by tuning the horns to the string keynotes by the sequences of n harmonic comparisons indicated on Table A.

With the horn tuned as designated, the suggested twelve-tone scale fingering are shown chromatically from F to F over three octaves. The calculated pitch correction to obtain string keynote pitch is indicated in Table B.

The suggested fingering and calculated pitch correction in each of the twelve-keys is shown in Tables C, D, E and F. With both twelve-tone and twelve-key capabilities in a single instrument of the present invention, the horn player can use the most appropriate twelve-tone or twelve-key fingering for a given composition. On high, long notes, the difference or beat frequency between two simultaneously played notes is most objectionable. The twelve-key approach is essential. On short, low notes, there is not enough time for the ear to detect the beat frequency and the twelve-tone approach may be adequate. It is preferable to use the twelve-key approach most of the time with only an occasional switch to less awkward twelve-tone fingerings. Twelve-tone compositions, rapid chromatic passages, or technically difficult passages are often easier to finger with a twelve-tone approach. Beginning students may learn the twelve-tone approach first and later learn each of the twelve-key fingerings one at a time.

The extra octave needed to play French horn literature requires a longer horn and higher values for n.

Higher n and the hand in the bell combine to produce narrower resonances, and thus, less flexibility in pitch. For that reason, the twelve-key technique is most appropriate for the French horn. The twelve-key technique of the present invention can be applied to other brass instruments also.

The first five valve B flat, E flat descant horn ever made is shown in FIG. 2. An alternative version using two single ganged change valves is shown in FIG. 3.

The previously given theoretical frequency relation for hand horns forms the basis for the present invention.

Special features are included in the five valve B flat-E flat descant horn to ensure that a practical horn accurately follows the theoretical frequency relation $f=nc/4L$. When an acoustic wave travels down a tube, a sudden change in tube diameter will cause a part of the wave to be reflected back along the tube. Reflections at the bell and at the mouthpiece cup are the only ones included in the theoretical relation. Normally a tapered fit connects the mouthpiece to the mouthpipe, resulting in a sudden change in diameter at the joint. That sudden change in diameter gives an unwanted reflection and is eliminated with a screwed-on mouthpiece connection. The screw also prevents the wobbling sometimes present in a tapered fit. Another unwanted feature usually present in most horns is frequency dependent tube breathing losses. Pressure fluctuations within the tube produce radial vibrations of the tube, which are coupled through braces to other parts of the horn. The acoustic losses by the coupled vibrations cause some of the notes to be out of tune and hard to play. The tube breathing losses are minimized by using cork braces bonded with hot glue throughout the horn.

The ease of compression and the low density of cork make it a good solid material to insulate sound. A block of cork is carved to fit snugly between two tubes $\frac{3}{8}$ inch or more apart. Jeweler's saw, razor blade, cork borer, files and sandcloth are all useful tools in this cut and try process. A thin layer of glue is applied with hot glue gun to the carved cork block wherever it had contacted a brass tube. After the glue hardens, the cork block is reinserted between the brass tubes. Heating the tubes with a hair dryer remelts the glue and bonds the cork to the tubes. Heat or paint remover may be used to remove excess glue.

The features of the screwed-on mouthpiece and the cork braces incorporated in the B flat-E flat descant horn have produced a horn with uniform response to the theoretical relation on all notes over four octaves.

The present invention provides a twelve-tone, twelve-key brass instrument with a five valve B flat-E flat descant version as the best compromise.

The use of a screwed-on mouthpiece connection to the mouthpipe and the cork braces produce a horn with a very good uniform response accurately following the $f=nc/4L$ relation for hand horns.

Another feature of the present horn is a valve operating lever, link and string bar connection which improves horn performance. Prior art horns use solid key levers, links and string bars which rotate about a single axle connected to the key. The string bars mount strings which are wrapped around the hubs of rotary valves to turn the valves as the key lever is depressed. In the prior art device, the string bar moves axially along the hub as well as tangentially along the hub. When the key is pressed, it rotates about the axle with a resultant rotation of about 15° of the string bar from its original position perpendicular to the axis of the rotary valve. That produces an unwanted awkwardness to the rotation of the hub by the nylon string which is attached to the string bar.

On more expensive horns such as Alexander Horns, an additional axle and bearing are added to maintain the string bar perpendicular to the axis of the rotary valve and thus smooth the action. On the horn of the present invention, a different construction is used to keep the string bar moving perpendicular to the valve hub.

As shown in FIG. 6, the point of a small nail is press fitted into the end of the string bar. The conical point of the nail is inserted into a slightly smaller hole or dimple in the link which is attached to the key. Tension on the nylon string keeps the point of the nail in the hole in the link. The nail point permits the string bar to remain perpendicular to the axis of the rotary valve. The resultant action is as smooth as the action which uses an additional bearing and axle, but requires less time and less expense to construct and is lighter in weight.

The twisted linen or nylon string which is used to connect the string bar to the hub is extended to connect the string bar to the link, which is connected to the key.

Any standard brass instrument can be made with the twelve-tone, twelve-key capability by applying the features of the present invention. One form of the invention is a B flat-E flat descant brass instrument having an alto range. If the length of the horn is made half as long, it becomes a coloratura brass instrument. If the length of the horn is made twice as long, it becomes a baritone brass instrument.

Another form of the invention is an F-B flat horn as a tenor brass instrument. If the length of that horn is made half as long, it becomes a soprano brass instrument. If the length of the horn is made twice as long, it becomes a bass brass instrument.

While the invention has been described with reference to the specific embodiments, modifications and variations of the invention may be made without departing from the scope of the invention, which is defined by the following claims.

TABLE A

| 5 valve F-B flat | 5 valve B flat-E flat |
|---|---|
| 20th of O to 440A | 15th of O to 440A |
| 18th of T to 24th of O | 12th of T to 16th of O |
| 18th of T2 to 16th of T | 18th of 2 to 16th of O |
| 24th of 2 to 16th of T | 12th of T2 to 16th of 2 |
| 16th of T1 to 20th of O | 16th of T1 to 20th of O |
| 24th of 1 to 18th of T1 | 16th of 1 to 12th of T1 |
| 18th of T23 to 20th of O | 18th of T23 to 20th of O |
| 24th of 23 to 20th of O | 24th of 23 to 20th of O |
| 24th of T14 to 20th of T1 | 18th of T14 to 20th of 1 |
| 32nd of 14 to 20th of T1 | 24th of 14 to 20th of 1 |

TABLE B

Twelve-Tone Fingering

| F-B flat | | | B flat-E flat | |
|---|---|---|---|---|
| T | | F | T | |
| T1 | | E | T1 | |
| T2 | | E flat | T | |
| T | | D | T1 | |
| T123 | | D flat | T2 | |
| T | −11 | C | T12 | −7 |
| T2 | | B | T123 | |
| T | | B flat | O | |
| T1 | | A | 1 | |
| T2 | | A flat | 2 | |
| T12 | −7 | G | 12 | −7 |
| T123 | | G flat | 123 | |
| T | | F | O | |
| T1 | | E | 1 | |

TABLE B-continued

| Twelve-Tone Fingering | | | | | |
|---|---|---|---|---|---|
| F-B flat | | | B flat-E flat | | |
| T2 | | E flat | 2 | | |
| T | | D | O | | |
| T123 | | D flat | T1 | | |
| O | −11 | C | T12 | −7 | |
| 1 | | B | T123 | | |
| T | | B flat | O | | |
| T1 | | A | 1 | | |
| T2 | | A flat | 2 | | |
| T12 | −7 | G | 12 | −7 | |
| T123 | | G flat | 123 | | |
| T | | F | O | | |
| T1 | | E | 1 | | |

TABLE B-continued

| Twelve-Tone Fingering | | | | | |
|---|---|---|---|---|---|
| F-B flat | | | B flat-E flat | | |
| T2 | | E flat | 2 | | |
| T23 | | D | 23 | | |
| T123 | | D flat | T1 | | |
| O | −11 | C | T12 | −7 | |
| 1 | | B | T123 | | |
| T | | B flat | O | | |
| T1 | | A | 1 | | |
| T2 | | A flat | 2 | | |
| T12 | −7 | G | 12 | −7 | |
| T123 | | G flat | 123 | | |
| O | | F | 24 | +4 | |

TABLE C

| 5 Valve F-B Flat 12-Key | | | | | | | | | | | | |
|---|---|---|---|---|---|---|---|---|---|---|---|---|
| | F | | B flat | | E flat | | A flat | | D flat | | G flat | |
| F | T | | T | | T | | T | | T123 | | T123 | |
| E | T1 | | T13 | −4 | T13 | −12 | T3 | −3 | T1 | T123 | | |
| E flat | T13 | −1 | T13 | −1 | T2 | | T2 | | T2 | | T2 | |
| D | T3 | −4 | T | | T | | T3 | +1 | T12 | | T4 | −1 |
| D flat | T1 | | T123 | | T3 | +5 | T3 | +5 | T123 | | T123 | |
| C | T | | T | | T | | T2 | | T2 | | T4 | +3 |
| B | T14 | +4 | T234 | +1 | T3 | −3 | T1 | | T23 | −3 | T4 | +5 |
| B flat | T13 | −1 | T | | T | | T2 | | T2 | | T123 | |
| A | T1 | | T1 | | 3 | +1 | T12 | | T4 | −1 | T23 | |
| A flat | T2 | | T | | T | | T2 | | T2 | | T123 | |
| G | T12 | +4 | T12 | +4 | T23 | | T23 | | 4 | +3 | T12 | |
| G flat | T234 | +1 | T14 | | T123 | | T2 | | T34 | +2 | T123 | |
| F | T | | T | | T | | T | | T134 | +3 | T134 | +3 |
| E | T1 | | T4 | −3 | T234 | +1 | T3 | −3 | T1 | | T123 | |
| E flat | T13 | −1 | T13 | −1 | T2 | | T2 | | T2 | | T2 | |
| D | T12 | +4 | T | | T | | T134 | −11 | T12 | | T4 | −1 |
| D flat | T1 | | T123 | | T3 | +5 | T3 | +5 | T123 | | T123 | |
| C | O | | O | | O | | T2 | | T2 | | T3 | −20 |
| B | T24 | +6 | T234 | +1 | T23 | | 1 | | T23 | −3 | T23 | −3 |
| B flat | 13 | −1 | T | | T | | T | | T | | T123 | |
| A | O | | T1 | | T34 | −11 | 12 | | T134 | | T1 | |
| A flat | T1 | | T13 | −1 | T13 | −1 | T2 | | T2 | | T2 | |
| G | T12 | −4 | T12 | +4 | T23 | | T23 | | T13 | −26 | T12 | |
| G flat | T4 | −29 | T14 | | T123 | | T34 | +2 | T34 | +2 | T123 | |
| F | O | | T | | T | | T | | T134 | +3 | T134 | +3 |
| E | T1 | | T124 | +6 | T234 | +1 | T3 | −3 | T1 | | T3 | −6 |
| E flat | T13 | −1 | T13 | −1 | T2 | | T2 | | T2 | | T2 | |
| D | T12 | +4 | T23 | | T23 | | T13 | −2 | T12 | | T4 | −1 |
| D flat | T14 | | T123 | | T34 | +2 | T34 | +2 | T123 | | T123 | |
| C | O | | O | | O | | T134 | +3 | T123 | +3 | T34 | −23 |
| B | T124 | +6 | T234 | +1 | 3 | −3 | 1 | | 3 | −6 | 3 | −6 |
| B flat | 13 | −1 | T | | T | | T | | T | | 13 | |
| A | 23 | | T1 | | T | −39 | 12 | | 4 | −1 | 23 | |
| A flat | T2 | | T13 | −1 | T13 | −1 | T2 | | T2 | | T2 | |
| G | T12 | +4 | T12 | +4 | T23 | | T23 | | T13 | −26 | T12 | |
| G flat | T4 | −29 | T14 | | T123 | | T34 | +2 | T34 | +2 | T123 | |
| F | O | | O | | O | | O | | T234 | +3 | T234 | +3 |

TABLE D

| 5 Valve F-B flat 12-Key | | | | | | | | | | | | |
|---|---|---|---|---|---|---|---|---|---|---|---|---|
| | B | | E | | A | | D | | G | | C | |
| F | T3 | +4 | T | −4 | T23 | +3 | T123 | | T23 | | T23 | |
| E | T123 | | T1 | | T1 | | T1 | | T1 | | T3 | −3 |
| E flat | T13 | +3 | T13 | +2 | T23 | −4 | T2 | −4 | T24 | −4 | T13 | +2 |
| D | T | | T4 | −4 | T4 | −4 | T | | T | | T | |
| D flat | T123 | | T123 | | T1 | | T1 | | T13 | −4 | T123 | −4 |
| C | T | −4 | T13 | +2 | T2 | | T13 | −1 | T13 | −1 | T2 | |
| B | T1 | | T1 | | T1 | | T1 | | T23 | | T23 | |
| B flat | T123 | | T134 | −3 | T | −4 | T14 | | T123 | | T234 | |
| A | T4 | −4 | T4 | −4 | T1 | | T1 | | T1 | | T23 | |
| A flat | T123 | | T14 | | T14 | | T124 | +6 | T2 | −4 | 3 | −3 |
| G | T4 | −1 | T23 | | T1 | | T1 | | T23 | | T23 | |
| G flat | T123 | | T123 | | T123 | | T14 | | T14 | | T234 | +1 |
| F | T13 | −11 | T | −4 | T23 | +3 | T134 | +3 | T23 | | T23 | |
| E | T123 | | T1 | | T1 | | T1 | | T1 | | T3 | −3 |
| E flat | T13 | +3 | T13 | +2 | T1234 | −6 | T2 | −4 | T24 | −4 | T13 | +2 |
| D | T23 | | T4 | −4 | T4 | −4 | T | | T23 | | T23 | |
| D flat | T123 | | T123 | | T1 | | T1 | | T4 | −29 | T123 | −4 |
| C | O | −4 | T13 | +2 | T2 | | T13 | −1 | T13 | −1 | T2 | |

TABLE D-continued

| | 5 Valve F-B flat 12-Key | | | | | | | | | | | |
|---|---|---|---|---|---|---|---|---|---|---|---|---|
| | B | | E | | A | | D | | G | | C | |
| B | 1 | | 1 | | 1 | | 2 | | T23 | | T23 | |
| B flat | T123 | | T1234 | −6 | T | −4 | T14 | | T123 | | T34 | +2 |
| A | T134 | | T134 | | T1 | | T1 | | T1 | | T1 | |
| A flat | T2 | | 1 | | 1 | | T124 | +6 | T2 | −4 | 3 | −3 |
| G | T4 | −1 | T23 | | T4 | −4 | T4 | −4 | T23 | | T23 | |
| G flat | T123 | | T123 | | T123 | | T14 | | T14 | | T4 | −29 |
| F | T34 | −22 | O | −4 | T234 | −8 | T134 | +3 | T134 | −11 | T134 | −11 |
| E | T3 | −6 | 1 | | T1 | | T1 | | T1 | | T3 | −3 |
| E flat | T13 | +3 | T13 | +2 | T1234 | −6 | T2 | −4 | T13 | −9 | T13 | +2 |
| D | T23 | | T4 | −4 | T4 | −4 | T23 | | T23 | | T23 | |
| D flat | T123 | | T123 | | T14 | | T14 | | T4 | −29 | T123 | −4 |
| C | O | −4 | T134 | +3 | T134 | +3 | T134 | −11 | T134 | +3 | | |
| B | 1 | | 1 | | 1 | | 1 | | 3 | −3 | 3 | −3 |
| B flat | 13 | +3 | T1234 | −6 | T | −4 | 13 | −12 | 13 | −1 | 13 | −12 |
| A | 4 | −4 | 4 | −4 | T1 | | T1 | | 23 | | 23 | |
| A flat | T2 | | 14 | | 14 | | T3 | −31 | T2 | −4 | T13 | −9 |
| G | T4 | −1 | T23 | | T4 | −4 | T4 | −4 | T23 | | T23 | |
| G flat | T123 | | T123 | | T123 | | T14 | | T14 | | T4 | −29 |
| F | T34 | −22 | O | −4 | T134 | −8 | T134 | +3 | T134 | −11 | T134 | −11 |

TABLE E

| | 5 Valve B flat-E flat descant 12-Key | | | | | | | | | | | |
|---|---|---|---|---|---|---|---|---|---|---|---|---|
| | F | | B flat | | E flat | | A flat | | D flat | | G flat | |
| F | T | | T | | T | | T | | T2 | | T2 | |
| E | T1 | | T34 | −2 | T1 | +7 | T23 | | T1 | | T23 | −3 |
| E flat | T13 | −1 | T13 | −1 | T | | T | | T2 | | T2 | |
| D | T12 | +4 | T1 | | T1 | | 3 | +1 | T12 | | T4 | −1 |
| D flat | 1 | | T2 | | T | | T | | T2 | | T2 | |
| C | O | | O | | O | | T23 | | T23 | | 4 | +3 |
| B | T3 | −6 | T234 | +1 | T14 | | T123 | | T2 | | T2 | |
| B flat | 13 | −1 | O | | O | | O | | O | | 123 | |
| A | 1 | | 1 | | T4 | −4 | 12 | | 4 | −1 | 1 | |
| A flat | 2 | | O | | O | | 2 | | 2 | | 2 | |
| G | 12 | +4 | 12 | +4 | 23 | | 23 | | T134 | −11 | 12 | |
| G flat | 234 | +1 | 14 | | 123 | | 2 | | 2 | | 123 | |
| F | O | | O | | O | | O | | T2 | | T2 | |
| E | 1 | | 4 | −4 | T234 | +1 | T23 | | 1 | | 123 | |
| E flat | 13 | −1 | 13 | −1 | 2 | | 2 | | 2 | | 2 | |
| D | 12 | +4 | O | | O | | T34 | −12 | 12 | | 4 | −1 |
| D flat | 1 | | T1 | | T13 | −1 | T13 | −1 | 123 | | 123 | |
| C | T12 | +4 | T12 | +4 | T12 | +4 | 2 | | 2 | | 2 | −19 |
| B | T4 | −18 | 234 | +1 | 23 | | T123 | | 23 | −3 | 23 | −3 |
| B flat | T134 | | O | | O | | O | | O | | 123 | |
| A | 1 | | 1 | | T124 | +7 | T124 | | 134 | | 1 | |
| A flat | 2 | | 13 | | 13 | −1 | 2 | | 2 | | 2 | |
| G | 12 | +4 | 12 | +4 | 23 | | 23 | | T13 | −26 | 12 | |
| G flat | T4 | −29 | 14 | | 123 | | T34 | +2 | T34 | +2 | 123 | |
| F | O | | O | | O | | O | | T134 | +3 | T134 | +3 |
| E | 1 | | T124 | +7 | T234 | +1 | 3 | −3 | 1 | | 3 | −6 |
| E flat | 13 | −1 | 13 | −1 | 2 | | 2 | | 2 | | 2 | |
| D | 12 | +4 | T1 | | T1 | | T | −39 | 12 | | 4 | −1 |
| D flat | 14 | | T2 | | T13 | −1 | T13 | −1 | 123 | | 123 | |
| C | T12 | +4 | T12 | +4 | T12 | +4 | T23 | | T23 | | T23 | −26 |
| B | T4 | −18 | 234 | +1 | T14 | | T123 | | T34 | +2 | T34 | +2 |
| B flat | T134 | | O | | O | | O | | O | | T134 | +3 |
| A | 1 | | 1 | | T124 | +7 | T124 | | 3 | −6 | 1 | |
| A flat | 2 | | 13 | −1 | 13 | −1 | 2 | | 2 | | 2 | |
| G | 12 | +4 | 12 | +4 | 23 | | 23 | | 13 | −26 | 12 | |
| G flat | 4 | −29 | 14 | | 123 | | 34 | +2 | 34 | +2 | 123 | |
| F | 24 | +4 | 24 | +4 | 24 | +4 | 24 | +4 | 134 | +3 | 134 | +3 |

TABLE F

| | 5 Valve B flat E flat descant 12-Key | | | | | | | | | | | |
|---|---|---|---|---|---|---|---|---|---|---|---|---|
| | B | | E | | A | | D | | G | | C | |
| F | T4 | +8 | T | −4 | T13 | +2 | T2 | | T13 | −1 | T13 | −1 |
| E | T4 | +7 | T1 | | T1 | | T1 | | T1 | | T23 | |
| E flat | T123 | | T123 | | T134 | −3 | T | −4 | T14 | | T123 | |
| D | T1 | | T134 | | T134 | | T1 | | T1 | | T1 | |
| D flat | T2 | | T123 | | 1 | | T14 | | 13 | −4 | T2 | −4 |
| C | T12 | | T4 | −1 | 2 | | T1 | | T1 | | T23 | |
| B | T123 | | T123 | | 1 | | 1 | | T14 | | 23 | |
| B flat | 123 | | T1234 | −5 | O | −4 | 14 | | 123 | | T23 | |
| A | T123 | | T123 | | 1 | | 1 | | 1 | | 23 | |
| A flat | 2 | | 14 | | 14 | | T1234 | −5 | 2 | −4 | T134 | +6 |

TABLE F-continued

| | 5 Valve B flat E flat descant 12-Key | | | | | | | | | | | |
|---|---|---|---|---|---|---|---|---|---|---|---|---|
| | B | | E | | A | | D | | G | | C | |
| G | 4 | −1 | 23 | | 1 | | 1 | | 23 | | 23 | |
| G flat | 123 | | 123 | | 123 | | 14 | | 14 | | 234 | +1 |
| F | 13 | −12 | O | −4 | 23 | +3 | T2 | | 23 | | 23 | |
| E | 123 | | 1 | | 1 | | 1 | | 1 | | T23 | |
| E flat | T123 | | T123 | | T1234 | −5 | 2 | −4 | T14 | | T123 | |
| D | 23 | | T134 | | T134 | | O | | 23 | | 23 | |
| D flat | 123 | | 123 | | 1 | | 1 | | T3 | −31 | T2 | −4 |
| C | T12 | +4 | T4 | −1 | 2 | | 13 | −1 | 13 | −1 | T23 | |
| B | T123 | | T123 | | T123 | | T123 | | 23 | | 23 | |
| B flat | 123 | | 1234 | −5 | O | −4 | 14 | | 123 | | 34 | +2 |
| A | 134 | | 134 | | 1 | | 1 | | 1 | | 1 | |
| A flat | 2 | | 13 | +2 | 13 | +2 | T1234 | −5 | 2 | −4 | 13 | −9 |
| G | 4 | −1 | 23 | | 4 | −4 | 4 | −4 | 23 | | 23 | |
| G flat | 123 | | 123 | | 123 | | 14 | | 14 | | T4 | −29 |
| F | T34 | −23 | O | −4 | T134 | −8 | T134 | +3 | T134 | −11 | T134 | −11 |
| E | 3 | −6 | 1 | | 1 | | 1 | | 1 | | 3 | −3 |
| E flat | 13 | +2 | 13 | +2 | T1234 | −5 | 2 | −4 | 13 | −9 | 13 | +2 |
| D | 23 | | T3 | −6 | T3 | −6 | T1 | | 23 | | 23 | |
| D flat | 123 | | 123 | | 14 | | 14 | | T3 | −31 | T2 | −4 |
| C | T12 | | T4 | −1 | T23 | | T4 | −4 | T4 | −4 | T23 | |
| B | T123 | | T123 | | T123 | | T123 | | T14 | | T14 | |
| B flat | T134 | +3 | 1234 | −5 | O | −4 | T134 | −8 | T134 | +3 | T134 | −11 |
| A | 3 | −6 | 3 | −6 | 1 | | 1 | | 1 | | 1 | |
| A flat | 2 | | 13 | +2 | 13 | +2 | T1234 | −5 | 2 | −4 | 13 | −9 |
| G | 4 | −1 | 23 | | 4 | −4 | 4 | −4 | 23 | | 23 | |
| G flat | 123 | | 123 | | 123 | | 14 | | 14 | | 4 | −29 |
| F | 34 | −23 | 24 | | 134 | −8 | 134 | +3 | 134 | −11 | 134 | −11 |

I claim:

1. A brass wind instrument comprising: a coiled tubular body portion terminating in a bell-shaped portion;

a valve carrying portion at an end of said body portion opposite said bell-shaped portion;

an inlet portion extending from said valve carrying portion to a mouthpiece end of the instrument;

at the inlet portion of the valve carrying portion the airstream enters a first switch valve, which in a first position directs the airflow through a low horn tuning slide and then through first, second, third and fourth low horn valves, mounted sequentially in a downstream direction, to a second switch valve, which connects the airstream to said body portion;

in a high horn ($\frac{3}{4}$ the low horn length) position the first switch valve directs the airstream sequentially through first, second, third and fourth high horn valves, through a high horn tuning slide, and then through the second switch valve to said body portion;

the first high horn valve and the first low horn valve are mechanically coupled and are operated by hand digit;

the second high horn valve and the second low horn valve are mechanically coupled and are operated by another hand digit;

the third high horn valve and the third low horn valve are mechanically coupled and are operated by another hand digit;

the fourth high horn valve and the fourth low horn valve are mechanically coupled and are operated by another hand digit;

the first switch valve and the second switch valve are mechanically coupled to form a change valve and are operated by another hand digit;

first, second, third and fourth low horn slides are connected respectively with said first, second, third and fourth low horn valves for communication with said body portion upon actuation of the respective valve to selectively increase the length of the air passage through the instrument;

first, second, third and fourth high horn slides are connected respectively with said first, second, third and fourth high horn valves for communication with said body portion upon actuation of the respective valve to selectively increase the length of the air passage through the instrument;

on both the high and low horns the first valve increases the open horn length by 0.066666 times the open horn length (half step), the second valve by 0.125 times the open horn length (whole step), the third valve by 0.075 times the open horn length (slightly more than a half step) and the fourth valve by 0.213333 times the open horn length (slightly more than one and a half steps).

2. A brass wind instrument as set forth in claim 1, wherein the order of the airflow is reversed for the high horn tuning slide and the four high horn valves, and the order of the airflow is also reversed for the four low horn valves and the low horn tuning slide.

3. A brass wind instrument as set forth in claim 1, wherein the high horn tuning slide is removed from between the two switch valves and inserted before the first switch valve in the valve carrying portion, making it a common slide for both horns.

4. A brass wind instrument as set forth in claim 1, wherein the high horn tuning slide is removed from between the two switch valves and inserted after the second switch valve in the valve carrying portion, making it a common tuning slide for both horns.

5. A brass wind instrument as set forth in claim 1, wherein the order of the airflow is reversed for the low horn tuning slide and the four low horn valves, and the high horn tuning slide is removed from between the two switch valves and inserted before the first switch valve in the valve carrying portion, making it a common tuning slide for both horns.

6. A brass wind instrument as set forth in claim 1, wherein the order of the airflow is reversed for the low horn tuning slide and the four low horn valves, and the high horn tuning slide is removed from between the two switch valves and inserted after the second switch valve in the valve carrying portion, making it a common tuning slide for both horns.

* * * * *